US006253430B1

(12) United States Patent
Wirz

(10) Patent No.: US 6,253,430 B1
(45) Date of Patent: Jul. 3, 2001

(54) SPIN DRAW TEXTURING OR DRAW TEXTURISING MACHINE WITH IMPROVED FIBER BUNDLE GUIDANCE

(75) Inventor: Armin Wirz, Ossingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/602,404

(22) Filed: Jun. 23, 2000

Related U.S. Application Data

(62) Division of application No. 09/143,746, filed on Aug. 31, 1998.

(30) Foreign Application Priority Data

Oct. 3, 1997 (CH) ..... 2322/97

(51) Int. Cl.[7] ..... D02G 1/16
(52) U.S. Cl. ..... 28/271; 28/220; 28/247
(58) Field of Search ..... 28/271, 272, 273, 28/274, 275, 276, 282, 268, 244, 220, 240, 247, 258, 219; 57/333, 350, 351, 908, 279, 90

(56) References Cited

U.S. PATENT DOCUMENTS

| | | | |
|---|---|---|---|
| 3,555,808 | 1/1971 | Gutman, Jr. . | |
| 3,577,615 | 5/1971 | Lenoir . | |
| 3,636,599 | 1/1972 | Stanley . | |
| 3,883,936 | 5/1975 | Stanley . | |
| 4,025,595 | 5/1977 | Mirhej . | |
| 4,055,039 | 10/1977 | Movshovich et al. . | |
| 4,064,605 | 12/1977 | Akiyama et al. . | |
| 4,301,579 | 11/1981 | Van Den Hoven . | |
| 4,593,521 | 6/1986 | Stalder et al. . | |
| 4,644,622 | 2/1987 | Bauer et al. . | |
| 5,008,991 | 4/1991 | Lachenmeier . | |
| 5,665,293 | 9/1997 | Karageorgiou et al. . | |
| 5,675,878 * | 10/1997 | Brown et al. | 28/271 |
| 6,041,587 * | 3/2000 | Gabalda et al. | 57/333 |
| 6,085,395 * | 7/2000 | Weiss | 28/221 |

FOREIGN PATENT DOCUMENTS

| | | |
|---|---|---|
| 1435517 | 1/1969 | (DE) . |
| 0434601A1 | 10/1990 | (EP) . |
| 0784109A3 | 1/1997 | (EP) . |
| 0784109A2 | 7/1997 | (EP) . |

OTHER PUBLICATIONS

European Patent Office Search Report, Apr. 9, 1998.

* cited by examiner

*Primary Examiner*—Amy B. Vanatta
(74) *Attorney, Agent, or Firm*—Dority & Manning

(57) ABSTRACT

The inventive arrangement of texturising nozzles (8) in a part of a spin draw texturising machine or a draw texturising machine presents a fan-like arrangement of these texturising nozzles in which the longitudinal axes (16) of the texturising nozzles extend coaxially with a connecting line (17) which extends from a take-off point (15) on a draw roll (1) to the exit of each individual texturising nozzle (8).

7 Claims, 1 Drawing Sheet

SPIN DRAW TEXTURING OR DRAW TEXTURISING MACHINE WITH IMPROVED FIBER BUNDLE GUIDANCE

The present application is a Divisional Application of U.S. application Ser. No. 09/143,746 filed on Aug. 31, 1998, the entire disclosure of which is hereby incorporated by reference.

BACKGROUND OF THE INVENTION

The present invention concerns the guidance of bundles of fibrils through a part of a spin draw texturing machine or a draw texturing machine including a texturising unit arranged downstream from a pair of rolls in which individual bundles of fibrils are transported in a transporting duct of texturising nozzle which is part of the texturising unit, and are texturised by means of plug formation in a texturising part also being part of the texturising nozzle, as well as a cooling unit provided downstream from the texturising unit which continually takes over the respective plugs, cools them and transfers them to a means (not shown) arranged subsequently for further processing steps.

Using a texturising method known as such from the European Patent Application EP 0 784 1094A1 in which a plurality of bundles of fibrils are drawn simultaneously on a pair of draw rolls and subsequently are texturised in a texturising unit with a plurality of texturising nozzles arranged side by side, it is found that the individual bundles of fibrils on the pair of draw rolls are guided at narrower distances from one bundle of fibrils to the next than the distance required from one texturising nozzle to the next.

On the other hand, the design height of the machine is to be kept as low as possible in order to permit stringing up of the filament bundles being sucked in at high speed into a so-called suction gun as quickly as possible from one end of the machine. The distances between the individual processing units are to be kept as small as possible.

These requirements are disadvantageous for the guidance of the bundles of fibrils between the draw roll giving off the fibrils and the texturising unit. As mentioned before, the distance from one bundle of fibrils to the next is to be kept as small as possible on the draw rolls whereas the distance from one texturising nozzle to the next for various reasons is to be kept substantially larger. Thus, the bundles of fibrils are spreading fan-like between the draw roll and the texturising unit in such a manner that they must be deflected at the mouth of each individual texturising nozzle.

In this arrangement on the draw roll the smaller distance of one bundle of fibrils to the next within a group is distinguished from the somewhat larger distance from one group to the next.

In order to maintain the distance between the second last of the groups and the last (outermost) group in spite of the fan-like spread mentioned before, guide elements must be provided between the individual draw rolls of a pair of draw rolls which guide the last group of bundles of fibrils distanced from the second last group in such a manner that, in spite of the transfer width of the last bundles of fibrils from the roll to the texturising unit, the group distance is kept to an acceptable value in order to avoid the necessity of providing rolls which are too long or the danger that the bundles of fibrils of the last group spread fan-like contact or overlap bundles of fibrils still present on the rolls.

These guide elements, be it deflecting elements between the rolls, or be it deflecting rolls arranged upstream from each texturising nozzle, present the disadvantage that they involuntarily cause an uncontrollable amount of damage to the individual bundles of fibrils, e.g. deformations of the cross-section of the fibrils, which are uncontrollable in so far as the deflection, in particular upstream from the mouth of each texturising nozzle, differs from one texturising nozzle to the next in such a manner that differences in the texturising effect are found in the individual bundle of fibrils which, under certain circumstances, become visible in the finished product, e.g. in the carpet.

OBJECTS AND SUMMARY OF THE INVENTION

It thus is a principal goal of the present invention to eliminate the disadvantages mentioned. Additional objects and advantages of the invention will be set forth in part in the following description, or may be obvious from the description, or may be learned through practice of the invention. The objects are achieved by means of the measures of the invention described herein for guiding the fiber bundles deflection-free from the draw rolls into the transporting ducts of the texturising device.

BRIEF DESCRIPTION OF THE DRAWINGS

The present invention is explained in the sense of examples with reference to the FIGS. 1 through 3. It is shown in the.

DETAILED DESCRIPTION

Figure 1:
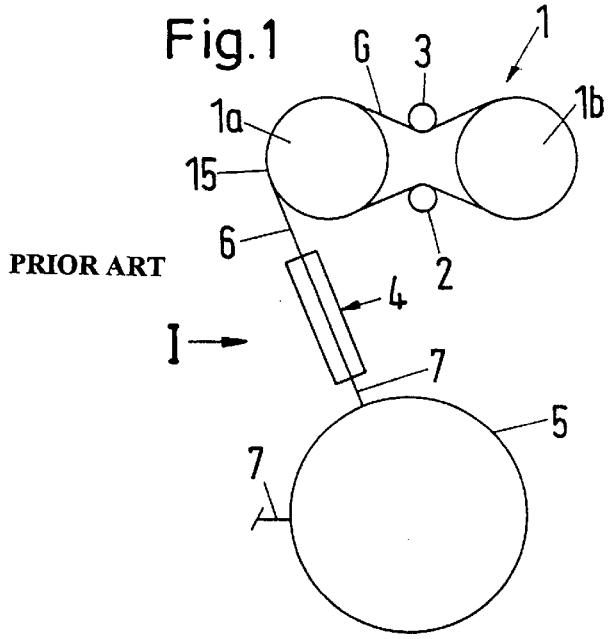
FIG. 1 is a view of a state of the art hampered by disadvantages discussed above.

Reference will now be made in detail to the presently preferred embodiments of the invention, one or more examples of which are illustrated in the drawings. Each example is provided by way of explanation of the invention, and not meant as a limitation of the invention. Various modifications can be made without departing from the scope and spirit of the invention.

In the FIG. 1 a pair of draw rolls 1, also called duo, is shown with the draw rolls 1A and 1B on which individual bundles of fibrils 6 are placed in groups 6.1 (FIG. 2) which in combination with a further preceding pair of draw rolls can be drawn in a manner known as such.

Figure 2:
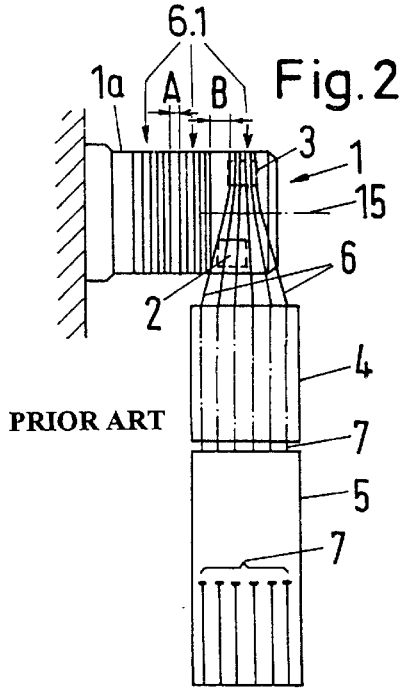
PRIOR ART Fig.2
FIG. 2 is a side view of the FIG. 1 seen in the direction I (FIG. 1)

In this arrangement, the groups, shown in FIG. 2, are distanced from each other by a distance A.

The bundles of fibrils 6 of the last group (FIG. 2) deflected by means of a lower deflecting guide element 2 provided between the draw rolls 1A and 1B as well by means of an upper deflecting guide element 3 arranged also between the draw rolls 1A and 1B but somewhat more towards the front or free end of the rolls 1A and 1B, are guided in such a manner that the last group of bundles of fibrils on the roll 1A is arranged at a greater distance B from the preceding group on the draw rolls which is greater than the distance A.

For the purpose, the deflecting elements 2 and 3 are provided with grooves for each of the bundles of fibrils. This prevents the bundles of fibrils of the last group, due to their spread caused by the substantially greater distance from one texturising nozzle center to the next compared to the distance from one bundle of fibrils to the next, from contacting or even overlapping within the group at a take-off point. In this arrangement, the deflecting elements can be stationary or can be rolls driven by the bundles of fibrils.

Furthermore the take-off point is represented by a straight line extending parallel to the roll axis along which the bundles of fibrils run side by side.

The bundles of fibrils 6 entering the texturising unit 4 at the mouth of the texturising unit 4, as shown in the FIG. 2, are deflected due to the spread of the bundles of fibrils between the take-off point 15 and the mouth of the texturising unit.

The deflections of the bundles of fibrils 6 at the lower deflection element 2 and at the upper deflection element 3, as well as the deflection at the mouth of the texturising unit 4, cause, as mentioned initially, due to the friction on the bundles of fibrils, damage which differs from one bundle of fibrils to the next and which is undesirable as it results in an unevenness in the finished thread.

Figure 4:
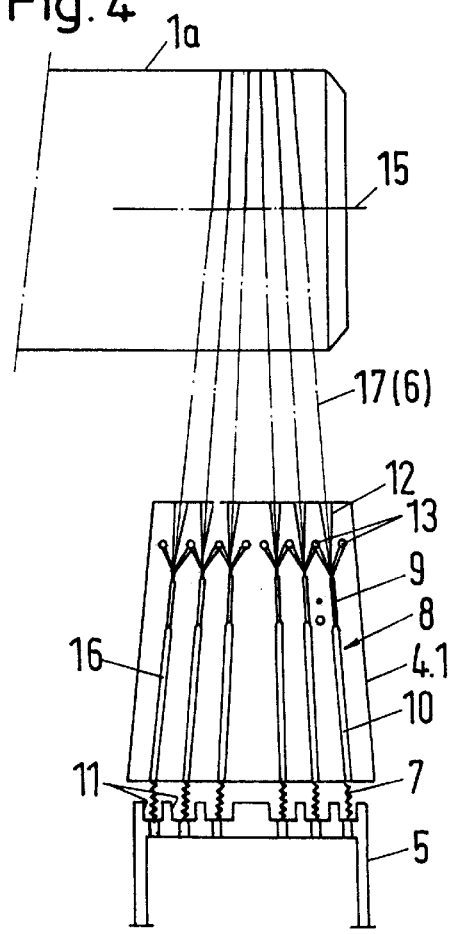
FIG. 4 is a partial side view of the FIG. 3 seen in the direction II (FIG. 3) to an enlarged scale.

In order to overcome this disadvantage, the individual texturising nozzles 8 are arranged, as shown in the FIG. 4, in a fan-like arrangement in such a manner that the longitudinal axes 16, indicated with dash-dotted lines, of each texturising nozzle 8 extend coaxial with a connecting line 17 also indicated with a dash-dotted line, which extends from the take-off point 15 to the exit of each texturising nozzle 8. In this arrangement, the connecting lines 17 at the same time correspond to the path of each bundle of fibrils 6 from the take-off point into the respective texturising nozzle 8.

Figure 3:
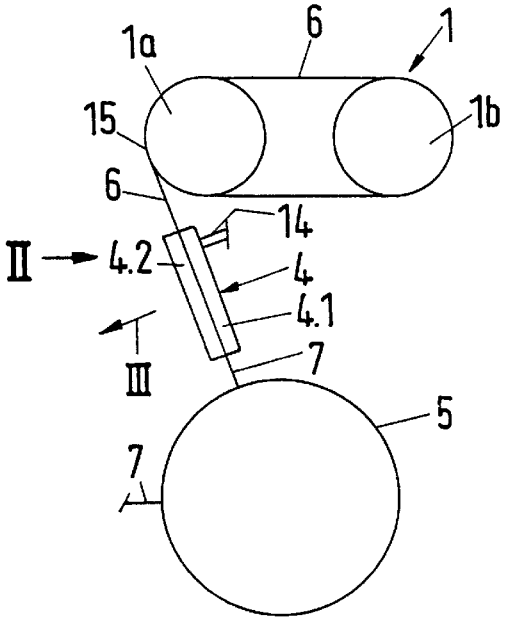
PRIOR ART Fig.3
FIG. 3 is a view in analogy to the FIG. 1 but in an arrangement according to the present invention without the disadvantages of the state of the art.

Owing to this fan-like arrangement of the texturising nozzles 8, as shown in the FIGS. 3 and 4, all deflecting guide elements mentioned earlier can be dispensed with.

The texturising nozzles 8 each give off a texturised bundle of fibrils to a cooling path each provided on the cooling drum 5.

The cooling drum is an element known as such, e.g. from the EP 0 310 890, and is not described further herein.

In the FIG. 4 only one half 4.1 of the texturising unit 4 according to the FIG. 3 is shown. The other half 4.2, as shown in the FIG. 3, is taken off in the direction III or is tilted open. This is shown here merely in order to permit better illustration of the path of the bundles of fibrils 6 as well as of the individual texturising nozzles 8.

Texturising units 4 which tilt or pivot open are known as such and are shown and described already e.g. in the European Patent EP-0 026 360 B1 as well as in EP-0 039 763 B1.

As shown in the FIG. 4 also, the respective texturising nozzles 8 are supplied via a transporting medium distribution duct 13 with a transporting medium in such a manner that based on a Venturi effect which is known as such the bundles of fibrils 6 by means of the transporting medium are sucked into the individual texturising nozzles 8 and transported through the transporting duct 9 into the texturising part 10 in which the bundles of fibrils are formed into a plug or are texturised into a texturised bundle of fibrils and from there are transferred each into a cooling path 11 each provided in the cooling drum 5.

The transporting medium supplied via a transporting medium supply duct 14 and via internal ducts (not shown) is supplied to the transporting medium distribution ducts 13.

The present invention is not restricted to the arrangement of the paths of the bundles of fibrils on the roll 1A according to the FIG. 4. In principle, the present invention concerns a guidance of the bundles of fibrils which essentially does not cause more intense deflections than, e.g., the guidance system which according to the FIG. 4 is provided on the uppermost circumferential line of the roll 1A to the take-off point 15, which on one hand depends on the friction between the bundles of fibrils and the surface of the roll 1A, and on the other hand depends on the thread tension prevailing in each bundle of fibrils 6 generated by the aspiration force of each texturising nozzle, and furthermore depends on the surface characteristics of the roll 1A.

Within the scope of these variations, the fan-like arrangement of the texturising nozzles 8 can be varied.

Thus, it will be apparent to those skilled in the art that various modifications and variations can be made in the present invention as come within the scope and spirit of the appended claims and their equivalents.

What is claimed is:

1. A spin draw texturizing or draw texturizing textile machine for forming yarn from fiber bundles, said machine comprising:

a pair of draw rolls and a texturizing unit downstream from said draw rolls in a conveying direction of fiber bundles through said machine;

a cooling unit downstream from said texturizing unit and disposed to receive texturized fiber bundles from said texturizing unit and convey said texturized fiber bundles to additional downstream processing devices;

said texturizing unit comprises adjacently disposed texturizing nozzles including transporting ducts configured therewith; and wherein said texturizing unit is disposed relative to said draw rolls so that a deflection-free conveying path is defined between a take-off point of the fiber bundles from said draw rolls to said texturizing nozzles such that the fiber bundles are conveyed directly to said texturizing nozzles from said take-off point without being contacted or deflected in their conveying direction.

2. The machine as in claim 1, wherein said transporting ducts of said texturizing nozzles are arranged in a pattern such that longitudinal axes of said transporting ducts are coaxial with said deflection-free conveying path of said fiber bundles.

3. The machine as in claim 2, wherein said transporting ducts are disposed in a diverging fan pattern corresponding to a conveying pattern of said fiber bundles from said take-off point.

4. A spin draw texturizing or draw texturizing textile machine for forming yarn from fiber bundles, said machine comprising:

a pair of draw rolls and a texturizing unit downstream from said draw rolls in a conveying direction of fiber bundles through said machine;

a cooling unit downstream from said texturizing unit and disposed to receive textured fiber bundles from said texturizing unit and convey said textured fiber bundles to additional downstream processing devices;

said texturizing unit comprises adjacently disposed texturizing nozzles including transporting ducts configured therewith; and wherein said transporting ducts of said texturizing nozzles are arranged in a pattern such that longitudinal axis of said transporting ducts are coaxial with said fiber bundles in their conveying direction from said draw rolls to said texturizing unit.

5. The machine as in claim 4 wherein said texturizing unit is disposed relative to said draw rolls so that a deflection-free conveying path is defined between a take-off point of the fiber bundles from said draw rolls to said texturizing nozzles from said take-off point without being contacted or deflected in their conveying direction.

6. A spin draw texturizing or texturizing textile machine for forming yarn from fiber bundles, said machine comprising:

a pair of draw rolls and a texturizing unit downstream from said draw rolls in a conveying direction of fiber bundles through said machine;

a cooling unit downstream from said texturizing unit and disposed to receive textured fiber bundles from said texturizing unit and convey said textured fiber bundles to additional downstream processing device;

said texturizing unit comprises adjacently disposed texturizing nozzles including transporting ducts configured therewith; and wherein said transporting ducts are disposed in a diverging fan pattern corresponding to a conveying pattern of said fiber bundles from a take-off point of the fiber bundles from said draw rolls to said texturizing nozzles.

7. The machine as in claim 6 wherein said texturizing unit is disposed relative to said draw rolls so that a deflection-free conveying path is defined between said take-off point of the fiber bundles from said draw rolls to said texturizing nozzles such that the fiber bundles are conveyed directly to said texturizing nozzles from said take-off point without being contacted or deflected in their conveying direction.

* * * * *